United States Patent [19]

Schuessler

[11] 4,329,742

[45] May 18, 1982

[54] PROTECTIVE KNITTED BAND FOR USE WITH SAFETY HATS

[76] Inventor: Walter E. Schuessler, 800 Redbud La., Wilmette, Ill. 60091

[21] Appl. No.: 218,915

[22] Filed: Dec. 22, 1980

Related U.S. Application Data

[63] Continuation-in-part of Ser. No. 108,518, Dec. 31, 1979, Pat. No. 4,272,853.

[51] Int. Cl.[3] ..... A42B 3/00; A42B 1/04

[52] U.S. Cl. ..... 2/424; 2/202; 2/185 R

[58] Field of Search ..... 2/202, 203, 205, 206, 2/208, 209, 171, 185 R, 199, 196, 209.1, 5, 422, 423, 424, 10

[56] References Cited

U.S. PATENT DOCUMENTS

| | | | |
|---|---|---|---|
| 1,690,736 | 11/1928 | Leicht | 2/208 |
| 3,100,896 | 8/1963 | Khanbegian | 2/5 |
| 3,169,252 | 2/1965 | Goldstein | 2/203 |
| 3,531,952 | 10/1970 | Chesebro, Jr. | 2/202 X |
| 4,091,469 | 5/1978 | Davidson | 2/423 X |

FOREIGN PATENT DOCUMENTS

| | | | |
|---|---|---|---|
| 125800 | 5/1919 | United Kingdom | 2/4 |

*Primary Examiner*—Peter P. Nerbun

*Attorney, Agent, or Firm*—Tilton, Fallon, Lungmus et al.

[57] ABSTRACT

A knitted headband for use with a safety hat to provide cold weather protection for a wearer. The band is circumferentially stretchable, has open upper and lower ends, and is formed of double thicknesses of knitted material. The upper portion of the band is dimensioned and adapted to be stretched over a hard hat, and a pair of diametrically-disposed slits are formed in the band intermediate the length thereof for receiving front and rear brim portions of the hat to secure the band in place. The front slit and the open lower end of the band are provided with elasticized borders to permit adjustment of the band into different positions to provide greater or lesser protection depending on the severity of weather conditions.

19 Claims, 6 Drawing Figures

PROTECTIVE KNITTED BAND FOR USE WITH SAFETY HATS

RELATED APPLICATION

This application is a continuation-in-part of my copending application Ser. No. 108,518, filed Dec. 31, 1979, now U.S. Pat. No. 4,272,853.

BACKGROUND AND SUMMARY

Protective liners for hard hats have long been known in the art and are disclosed, by way of examples, in U.S. Pat. Nos. 3,205,508 and 2,339,080. The purpose of such a liner is to provide cold weather protection for a wearer's head since a conventional hard hat is normally spaced from a wearer's head by means of a harness and, therefore, such a hot provides little if any protection from the cold. A long-existing problem has been to combine a liner with a hard hat in such a way that cold weather protection will be readily available when needed but, when not needed, the liner may be easily removed or shifted into a non-functional position. If such a liner extends into the head space defined by the harness, then removal of that liner in warm weather will require readjustment of the headband size of the harness, whereas if the liner extends into the space between the harness and the hard hat, detachment of such a liner may first require removal of the harness from the hat. In either case, considerable time-consuming manipulation is required in order to attach or detach such liners.

U.S. Pat. Nos. 3,205,508 and 3,594,814 discloses constructions designed to facilitate retraction of a liner when cold weather protection for the face, neck, and ears is not required. While the provision of a liner which may be readily extended and retracted reduces some of the aforementioned problems, it does not eliminate those problems because the presence of a liner, even when fully retracted, may still be objectionable under warm weather conditions. The inconvenience of periodically detaching and reattaching a liner, commonly accompanied by the steps of disconnecting, adjusting, and remounting a harness, still exists with the use of such retractable liners even though such operations may be performed less frequently.

Other patents disclosing the state of the prior art are U.S. Pat. Nos. 3,100,896, 3,271,781, 3,169,252, 3,146,462, and British Pat. No. 15,232.

This invention is concerned with an improved protection headband for use with hard hats, such band being readily attachable and detachable from a hard heat whenever removal and replacement are desired. While such removal would commonly occur when improved conditions no longer require cold weather protection for a wearer's face and ears, the band might also be removed for cleaning or repair, or replacement by a new band. Ease of detachability is also important where, for example, a band has become wet from rain or snow and removal is desired to facilitate drying of the band, possibly while a replacement band is being used.

A further object of this invention is to provide an easily removable and attachable band for hard hats which is readily adaptable for use with hats of different size, style, and configuration. While all conventional hard hats have rigid crown and brim portions which are integrally formed from impact-resistance plastic or, less frequently, from metal, differences do exist in the sizes and shapes of the brims, the contours of the crowns, and the configurations and numbers of stiffening ribs extending across such crowns. The band of this invention is designed to cooperate with all conventional hard hats regardless of such variations.

A still further object is to provide a band which may be readily shifted into different positions of adjustment depending on the extent of cold weather protection desired by a wearer and which, in each of such positions, cooperates with the hat to become anchored or fixed against sliding movement that might result in detachment from the hat or in unintentional movement out of the selected position of adjustment.

One aspect of this invention lies in recognizing that many of the aforementioned problems associated with cold weather liners for hard hats may be overcome by providing a band which fits over rather than within such a hat. The band takes the form of a circumferentially-stretchable tube having open upper and lower ends and formed of double thicknesses of knitted material. The upper portion is dimensioned to be stretched about the outside of a hard hat with the lower portion of the tube, having an elasticized border about its open lower end, extending downwardly (or inwardly) from the brim of the hat. A pair of diametrically-disposed slits are provided in the front and rear portions of the tube, at least the front slit being provided with an elasticized border. In one position of adjustment, front and rear brim portions of the hat project through the diametrically-disposed slits with the lower portion of the tubular band extending across a wearer's forehead and temples, over the ears, and behind the neck. In a second position of adjustment, the front slit is disengaged from the brim of the hat and is expanded beneath the brim to define an enlarged face opening, the portion formerly serving as a forehead band becoming a chin strap. A third position of adjustment is similar to the first except that the elasticized border about the lower opening of the tubular band is urged downwardly to encircle the wearer's head within the opening defined by the brim of the hat. Movement between all of such positions of adjustment may be achieved without removing the protective tubular band from the hat, and without removing the safety hat from the wearer's head.

Other objects, features, and advantages of the invention will become apparent from the specification and drawings.

DRAWINGS

DETAILED DESCRIPTION

Figure 1:
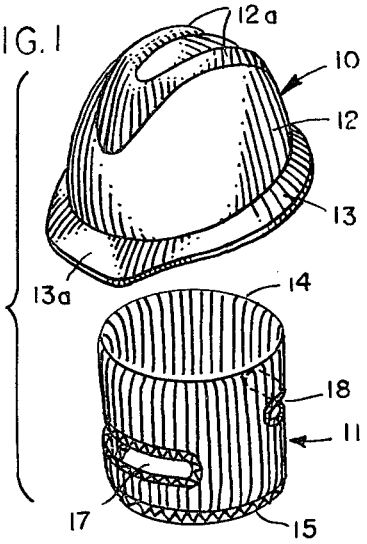
FIG. 1 is an exploded perspective view of a band and a hard hat combination embodying the present invention.

Referring to the drawings, FIG. 1 illustrates a hard hat 10 and a knitted tubular band 11. The hat 10 is of conventional construction, having a dome-like crown portion 12 and a perimetric brim portion 13. While the brim may be of substantially uniform width throughout its entire extent, quite typically such a brim has an enlarged front or beak portion 13*a* which functions as a visor. The crown may include one or more external ribs 12*a* which reinforce the crown. Normally such a hat is integrally formed from a tough, rigid, and electrically-insulating plastic material although, where electrical insulating properties are not desired, other materials such as metals may be used.

Within the hat is a harness which is dimensioned to rest upon a wearer's head so that a space is provided between the head and the inside surface of the hard hat. Such a harness is not shown in the drawings and forms no direct part of this invention; however, reference may be had to U.S. Pat. No. 3,594,814 for the disclosure of a conventional harness and its relationship to a hard hat.

Figure 3:
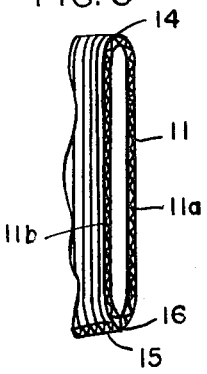
FIG. 3 is a vertical cross sectional view taken along line 3—3 of FIG. 2.

Band 11 takes the form of a knitted tube having open upper and lower ends 14 and 15, respectively. the tube is composed of double thicknesses of knitted material 11*a* and 11*b* and is ideally formed in one piece, in which case the inner and outer layers are joined at the upper end 14 by an integral roll or bridging portion (FIG. 3). Elastic stitching 16 extends about the open lower end of the tube to perform the dual functions of joining the inner and outer layers together and elasticizing the border to insure full recovery when stretching forces are removed.

The tubular band 11 is knitted with its ribs extending longitudinally or axially and, therefore, the band is highly stretchable in circumferential directions. When unstretched or untensioned, the diameter of the band is substantially smaller than the maximum diameters of the brim portion 13 and crown portion 12 of hard hat 10. By way of example, the band may have a diameter in an unstretched state within the general range of 3 to 7 inches, depending largely on the tightness of the knit and the type of yarn used, whereas a typical hat might have maximum outside diameters of approximately 8 to 10 inches measured at the crown and 10 to 12 inches measured at the brim. The length of the band may be approximately the same as its diameter although, preferably, such length is slightly greater, falling generally within the range of about 6 to 9 inches. In the embodiment illustrated, the edge 15 defining the open lower end of the band is canted in relation to the longitudinal axis of the tube, with the length at the front of the tubular band being the shorter dimension and the length at the rear being the greater dimension. Such angle may fall anywhere within the general range of 0 to 10 degrees measured from a plane normal to the axis of the tube.

A pair of diametrically-disposed slits 17 and 18 are provided at the front and rear of the band. Each slit extends transversely and has an elasticized border 17*a* and 18*a* formed by elastic stitching in a manner well known in the art. The term "elastic stitching" is used herein to mean not only stitching composed of elastic thread but also stitching which, although not elastic in itself, encloses an elastic band or web in a way that does not impair the stretchability of that band. For example, the stitching that borders slits 17 and 18, as well as the stitching that borders lower opening 15, may take the form of overcast stitching which secures and conceals elastic bands.

Front slit 17 is diposed closer to the lower end of the tube, whereas rear slit 18 is positioned closer to the tube's upper end. It will also be noted that the front slit 17 is substantially larger than rear slit 18. In general, the front slit should have a circumferential dimension within the range of about 4 to 6 inches, whereas the rear slit should have a corresponding dimension within the range of 2 to 4 inches, both such dimensions being determined when the tube is in an unstretched or untensioned state.

Figure 4:
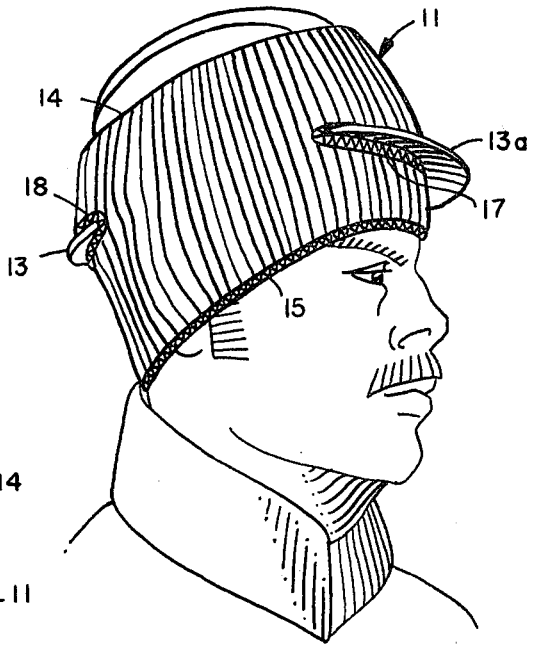
FIG. 4 illustrates the band as it is worn in a first position of adjustment.
Figure 2:
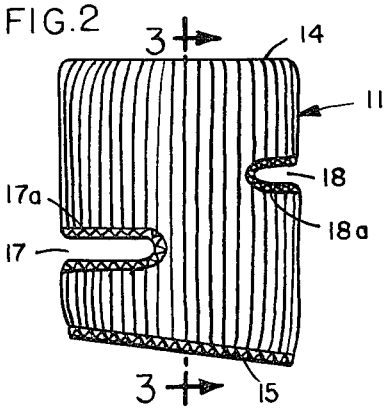
FIG. 2 is a side elevational view of the band.

FIG. 4 illustrates the relationship of the band 11 and hat 12 when such elements are assembled with the beak or front portion 13*a* of the brim projecting through front opening 17, and with the rear portion of the brim extending through slit 18. Because of the different axial positions of the circumferentially-disposed slits, the tubular band 11 assumes an upwardly and rearwardly sloping relationship with respect to the hat. The canting of the elasticized edge at the lower end 15 of the tube also contributes to providing a greater length of knitted fabric extending downwardly from the brim at the rear of the hat, in contrast to the length of material extending downwardly beneath front brim portion 13*a*. The result is a construction which, when worn in the position shown in FIG. 4, protects not only the wearer's forhead but also his temples, ears, and back of the neck.

Figure 5:
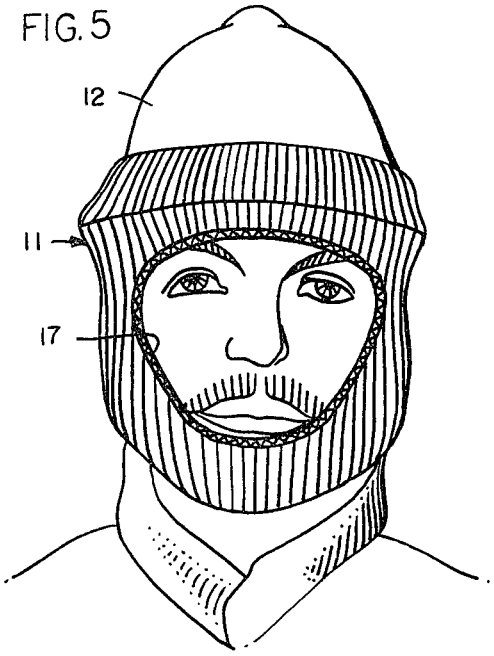
FIG. 5 illustrates the band in a second position of adjustment.

The position of adjustment shown in FIG. 4 is an intermediate position, providing substantial protection under cold weather conditions. When even greater protection is needed, the wearer simply pulls the front portion of the band downwardly, disengaging the slit 17 from beak 13*a* and enlarging the expandable opening 17 to form a face opening (FIG. 5). The rear portion of the brim 13 continues to project through rear slit 18 in the same manner depicted in FIG. 4, thereby anchoring the band against downward movement as a whole and preventing disengagement between the band and hat. In effect, slit 18 and the rear portion of brim 13 function as a pivotal interconnection between the band and hat, thereby facilitating movement of the band between the positions of FIGS. 4 and 5. It is to be noted that when the band is so lowered, the portion which formerly extended across the wearer's forehead (FIG. 4) becomes a chin strap covering the front and lower portions of a wearer's chin (FIG. 5). The elasticized border about lower opening 15 of the band extends beneath the wearer's chin and rearwardly about the back of his neck.

Figure 6:
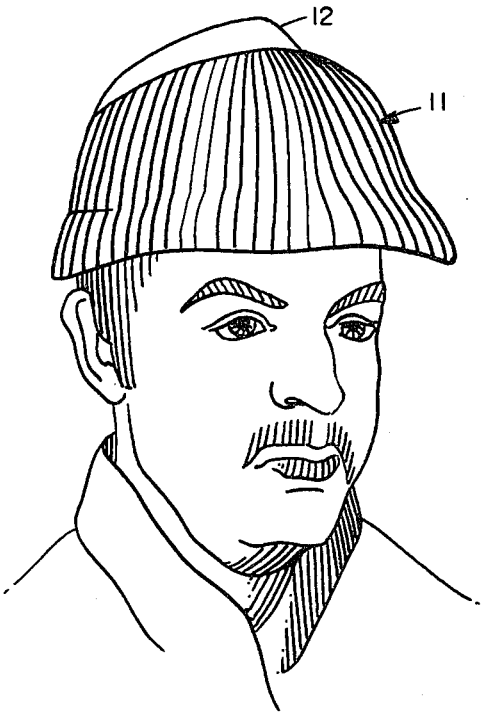
FIG. 6 illustrates the band in a third position of adjustment.

The position of adjustment illustrated in FIG. 6 is similar to that of FIG. 4, the major difference being that the elasticized border of the tube's lower end 15 has been urged upwardly to approximately the level of the brim of the hat 12. The elastic stitching of that border should be formed so that it snugly but comfortably engages the wearer's head about the crown thereof. The band therefore prevents cold drafts from passing upwardly between the shell of the hard hat and the wearer's head without, at the same time, blocking ventilation necessary for the wearer's comfort.

A second difference between the position of FIG. 6 and that of FIG. 4 is that front slit 17 has been disengaged from beak 13*a* and is positioned in collapsed condition beneath that beak. Such repositioning of the slit 17 not only improves the external appearance of the hat but promotes greater ventilation when such an increase is desired. It is to be understood, however, that at the wearer's option, the elasticized lower edge portion 15 of the band may be raised into a position extending about the wearer's crown (FIG. 6) without disengaging slit 17 from beak 13*a*.

While in the foregoing I have disclosed an embodiment of the invention in considerable detail for purposes of illustration, it will be understood by those skilled in the art that many of these details may be varied without departing from the spirit and scope of the invention.

I claim:

1. A protective band for use with a safety hat having rigid integral crown and brim portions, said band comprising a circumferentially-stretchable tube having open upper and lower ends and being formed of double thicknesses of knitted material; elastic stitching joining the double thicknesses of material at said lower end; said tube when unstretched having a diameter substantially smaller than the diameter of the brim of a safety hat to be worn therewith; said tube having a first transversely-extending brim-receiving slit intermediate the length of the tube, and a second transversely-extending brim-receiving slit diametrically disposed relative to said first slit; and an elasticized border extending around said first slit for engaging the brim and holding the band in place when the brim is extended through said first slit with said band being worn in a raised position; said elasticized border of said first slit also being stretchable for alternatively forming said first slit into a face opening spaced beneath the brim when said band is worn in a lowered position.

2. The band of claim 1 in which the lower end of said tube extends along a plane angled with respect to the axis of said tube so that the length of said tube through said second slit is greater than the length of said tube through said first slit.

3. The band of claim 1 in which the double thicknesses of knitted material are integrally formed at the upper end of said tube to define a rolled annular edge.

4. The band of claim 1 in which said first slit is closer to said lower end than to said upper end.

5. The band of claims 1 or 4 in which said second slit is closer to said upper end than to said lower end.

6. The band of claim 1 in which said first slit is substantially wider than said second slit.

7. The band of claim 1 in which said tube has a length within the range of 6 to 9 inches and an unstretched diameter within the range of 3 to 7 inches.

8. The band of claims 1 or 7 in which said first slit has a width when said tube is unstretched within the range of 4 to 6 inches.

9. The band of claim 8 in which said second slit has a width within the range of 2 to 4 inches.

10. A safety hat having rigid integral crown and brim portions and a tubular band of stretchable knitted fabric having open upper and lower ends and formed of double thickness of knitted material; and said band having a maximum diameter in an unstretched state substantially smaller than the brim of said safety hat and having the upper portion thereof stretched about and tightly receiving said brim and crown portions of said hat; said tube having a front transversely-extending slit adapted to receive the front portion of said brim and having a diametrically-disposed transversely-extending rear slit receiving a rear portion of said brim; said front slit of said band being positioned closer to the lower end of said tube than to the upper end thereof and being provided with an elasticized border extending thereabout for engaging the front portion of the brim when said front brim portion extends through said front slit with said band being worn in a raised position; said elasticized border of said front slit also being stretchable for alternatively forming said front slit into a face opening spaced beneath the brim when said band is worn in a lowered position.

11. The combination of claim 10 in which said double thicknesses of knitted material are joined together by elastic stitching at the lower end of said band.

12. The combination of claim 11 in which the double thicknesses of knitted material are integrally formed at the upper end of said band to define a rolled annular edge.

13. The combination of claim 10 in which the lower end of said band extends along a plane angled with respect to the axis of said band so that the length of said band at the rear thereof is greater than the length at the front thereof.

14. The combination of claim 10 in which said rear slit is closer to the upper end of said band than to the lower end thereof.

15. The combination of claim 10 in which said front slit is substantially wider than said rear slit.

16. The combination of claim 10 in which said band has a length within the range of about 6 to 9 inches.

17. The combination of claim 16 in which said band has an unstretched diameter within the range of about 3 to 7 inches.

18. The combination of claims 10, 16, or 17 in which said front slit has a width when said band is unstretched within the range of about 4 to 6 inches.

19. The combination of claim 18 in which said rear slit has a width when said band is unstretched within the range of about 2 to 4 inches.

* * * * *